US005517695A

United States Patent [19]

Murray

[11] Patent Number: 5,517,695

[45] **Date of Patent: * May 21, 1996**

[54] CAP STRAP COVERING DEVICE

[75] Inventor: Jeffrey A. Murray, Edina, Minn.

[73] Assignee: CM Marketing Group, Inc., Minneapolis, Minn.

[ * ] Notice: The portion of the term of this patent subsequent to Feb. 22, 2011, has been disclaimed.

[21] Appl. No.: 194,486

[22] Filed: Feb. 10, 1994

Related U.S. Application Data

[63] Continuation-in-part of Ser. No. 900,112, Jun. 18, 1992, Pat. No. 5,287,559.

[51] Int. Cl.[6] ..... A42B 1/24

[52] U.S. Cl. ..... 2/195.1; 2/181.4; 2/195.2; 2/209.13; 40/329

[58] Field of Search ..... 2/209.13, 20, 181, 2/181.4, 181.6, 181.8, 182.1, 182.2, 182.3, 182.5, 195.1, 195.2, 195.3, 195.5, 209.14, 244, 246, 267, 268, DIG. 11; 40/299, 329, 330, 665

[56] References Cited

U.S. PATENT DOCUMENTS

| | | | |
|---|---|---|---|
| Re. 33,430 | 11/1990 | Nunnery et al. | 2/181 |
| 525,287 | 8/1894 | Ruth . | |
| 676,293 | 6/1901 | Wright . | |
| 1,294,595 | 2/1919 | Allen . | |
| 1,559,917 | 11/1925 | Schnebel . | |
| 1,808,966 | 6/1931 | Morgan . | |
| 2,181,446 | 11/1939 | Ames . | |
| 4,776,043 | 10/1988 | Coleman | 2/199 |
| 4,856,116 | 8/1989 | Sullivan | 2/181 |
| 4,872,218 | 10/1989 | Holt | 2/171.5 |
| 4,905,406 | 3/1990 | Warner | 43/107 |
| 4,941,210 | 7/1990 | Konucik | 2/171 |
| 5,003,640 | 4/1991 | Pizzacar | 2/199 |
| 5,161,259 | 11/1992 | Shorts | 2/199 |
| 5,239,705 | 8/1993 | Leopold | 2/209.13 |
| 5,276,985 | 1/1994 | Halloran | 2/209.13 |
| 5,282,278 | 2/1994 | Miner | 2/209.13 |
| 5,287,559 | 2/1994 | Christiansen et al. | 2/209.13 |

FOREIGN PATENT DOCUMENTS

| | | |
|---|---|---|
| 444667 | 3/1936 | United Kingdom . |

*Primary Examiner*—Diana Biefeld
*Attorney, Agent, or Firm*—Westman, Champlin & Kelly

[57] ABSTRACT

A cap strap cover device covers a sizing strap on a cap. The cap has a covering portion with a hemispheric opening adjacent the sizing strap. The cover device includes a padded structure having first and second portions formed by a hinge allowing the first and second portions to fold relative to one another. The first and second portions fold into a folded position around the cap sizing strap. The padded structure includes a perimeter and a display surface having indicia displayed thereon. The display surface is located on the padded structure so that the indicia is visible when the padded structure is in the folded position. A fastener is provided for holding the first and second portions of the padded structure in the folded position around the cap sizing strap. An appendage is coupled to the padded structure and extends beyond the perimeter of the padded structure.

20 Claims, 6 Drawing Sheets

CAP STRAP COVERING DEVICE

REFERENCE TO CO-PENDING APPLICATION

The present application is a Continuation-in-Part Application of U.S. patent application Ser. No. 07/900,112, filed on Jun. 18, 1992, entitled CAP STRAP COVER COMFORTER now U.S. Pat. No. 5,287,559.

BACKGROUND OF THE INVENTION

The present invention relates to a baseball-cap strap cover. More particularly, the present invention relates to a baseball-cap strap cover with a display area and an improved method of increasing visibility and drawing attention to the display area.

The cap strap cover device of the present invention was invented to eliminate the uncomfortable plastic, leather, or other sizing strap designs on baseball-style caps. Since there is no prior art this can only be specific toward the uncomfortable design of the sizing strap itself.

When wearing a baseball-style cap forward or backward the sizing strap is not comfortable when exposed to a bare forehead or to the back portion of a person's head or upper neck. Consequently, the purpose of the cap strap cover comforter is to pad the area in which the sizing strap has always been uncomfortable and at times will leave an impression or mark on one's bare skin. The cap strap cover comforter is composed of a pad covered with fabric that folds up, under and over the sizing strap of a baseball-style cap, fastening together opposite the fold. Furthermore, today's baseball-style cap is worn more frequently backward than in the past, exposing the sizing strap to a person's forehead and, in most accounts, bare skin.

OBJECTS AND ADVANTAGES

Accordingly, several objects and advantages of my invention are:

(a) When wearing a baseball-style cap forward or backward my cap strap cover comforter covers the hole or gap that is open above the sizing strap, providing added protection from the undesirable weather—be it rain or cold temperatures;

(b) the cap strap cover comforter keeps the sizing strap from digging into a person's bare skin, thus eliminating the strap imprint on the person's head when the baseball-style cap is taken off;

(c) the cap strap comforter provides a means to absorb perspiration;

(d) the cap strap cover comforter offers a person the means to make two statements while wearing the baseball-style cap—the logo or slang saying provided on the cap strap cover comforter (i.e., NBA logos, NFL logos, college names, favorite soft drinks, etc.) in addition to what the baseball-style cap may already say on the front side;

(e) the cap strap cover comforter can be used on any and all baseball-style caps that have sizing straps; and (f) the present device provides increased visibility of the cap strap comforting device and draws attention to the display area on the cap strap comforting device.

Further objects and advantages are to provide a simple-to-use, inexpensive, novel product that can represent a special event or team logo without the expense of purchasing a whole baseball cap. Still further objects and advantages will become apparent from a consideration of the ensuing descriptions and drawings.

SUMMARY OF THE INVENTION

A cap strap cover device covers a sizing strap on a cap. The cap has a covering portion with a hemispheric opening adjacent the sizing strap. The cover device includes a padded structure having first and second portions formed by a hinge allowing the first and second portions to fold relative to one another. The first and second portions fold into a folded position around the cap sizing strap. The padded structure includes a perimeter and a display surface having indicia displayed thereon. The display surface is located on the padded structure so that the indicia is visible when the padded structure is in the folded position. A fastener is provided for holding the first and second portions of the padded structure in the folded position around the cap sizing strap. An appendage is coupled to the padded structure and extends beyond the perimeter of the padded structure.

Figure 1:
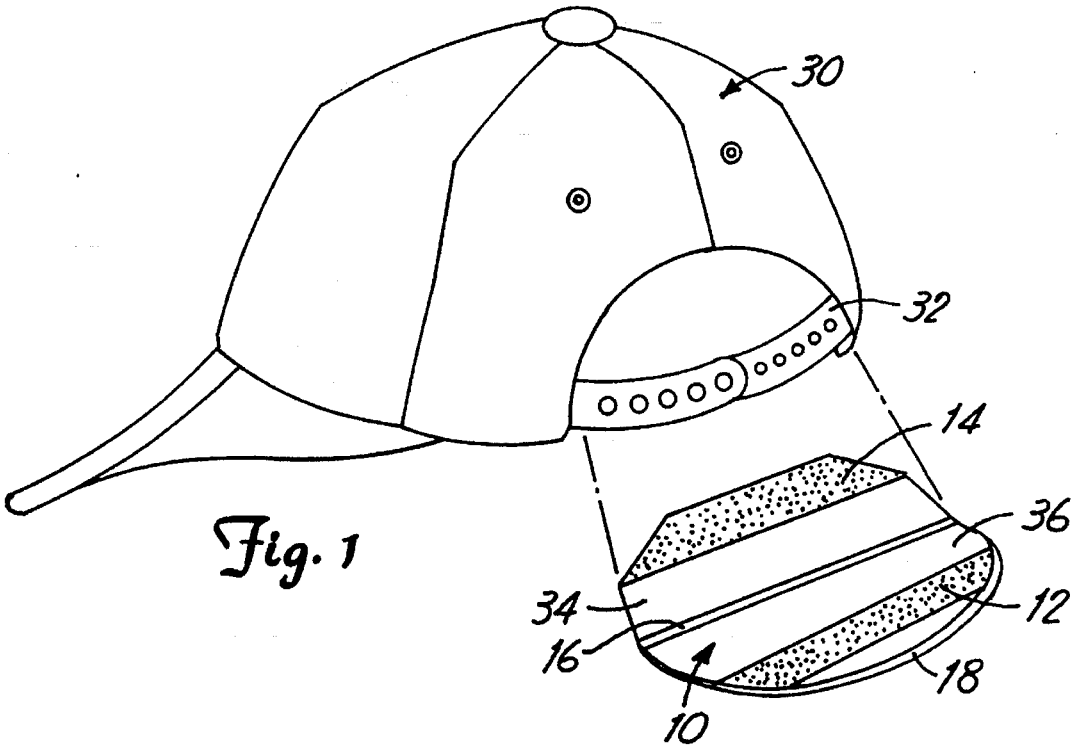
FIG. 1 is a perspective view of a baseball-style cap with cap strap cover comforter separated from the plastic style sizing strap.
Figure 2:
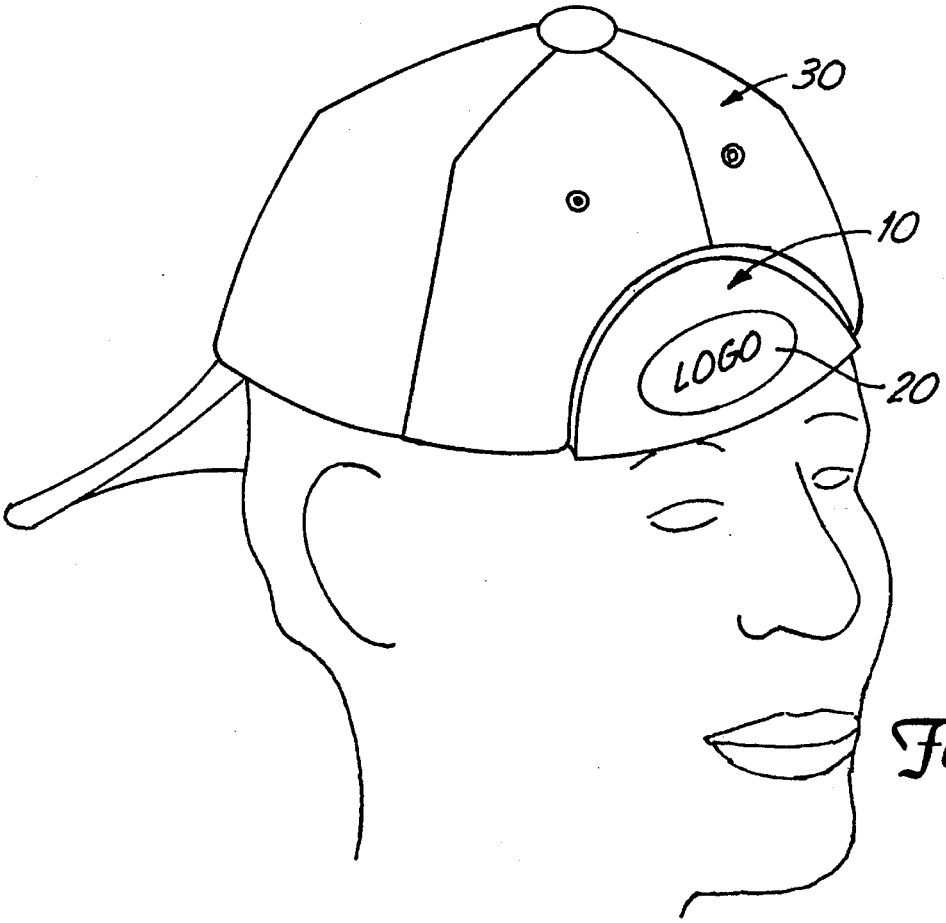
FIG. 2 is a perspective view of the cap strap cover comforter attached to the sizing strap of a baseball-style cap and in a fastened state.

REFERENCE NUMERALS 10 the cap strap cover comforter
12 hook component of hook-and-loop
14 loop component of hook-and-loop
16 double seam stitch
18 bias tape trim
20 front logo space
22 back cover fabric
24 pad substraight structure
26 hinge gap
28 front cover fabric
30 baseball-style cap
32 baseball-style cap sizing strap
34 inside lower portion of cap strap comforter
36 inside upper portion of cap strap cover comforter
38 appendage 40 appendage
42 perimeter of padded structure
44 covering portion of cap
46 optional display surface
48 optional display surface
50 appendage
52 appendage
54 interface between appendage and padded structure
56 interface between appendage and padded structure
58 appendage
60 appendage
62 rim of cap
64 indicia
66 indicia

DETAILED DESCRIPTION OF THE PREFERRED EMBODIMENTS

FIG. 1 shows a perspective view of the cap strap cover comforter 10 separated from a baseball-style cap 30 and its sizing strap 32. The baseball-style cap sizing strap 32 illustrated is a plastic snap-style sizing strap. It should be understood that there are sizing straps that are constructed in different forms and are not illustrated here. These other styles of sizing straps have the same function, and when the cap strap cover comforter 10 is applied and fastened its function is the same as illustrated here.

Figure 3:
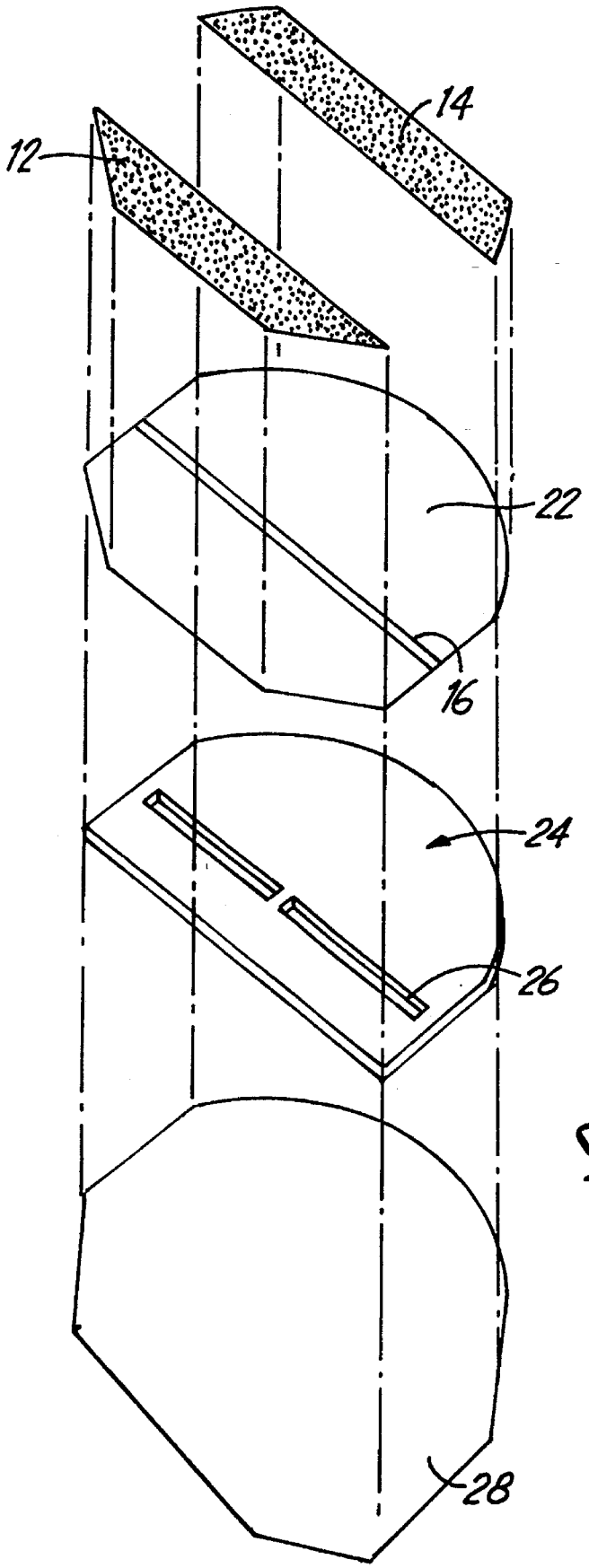
FIG. 3 is an exploded view of the cap strap cover comforter, illustrating the layers of construction.
Figure 5:
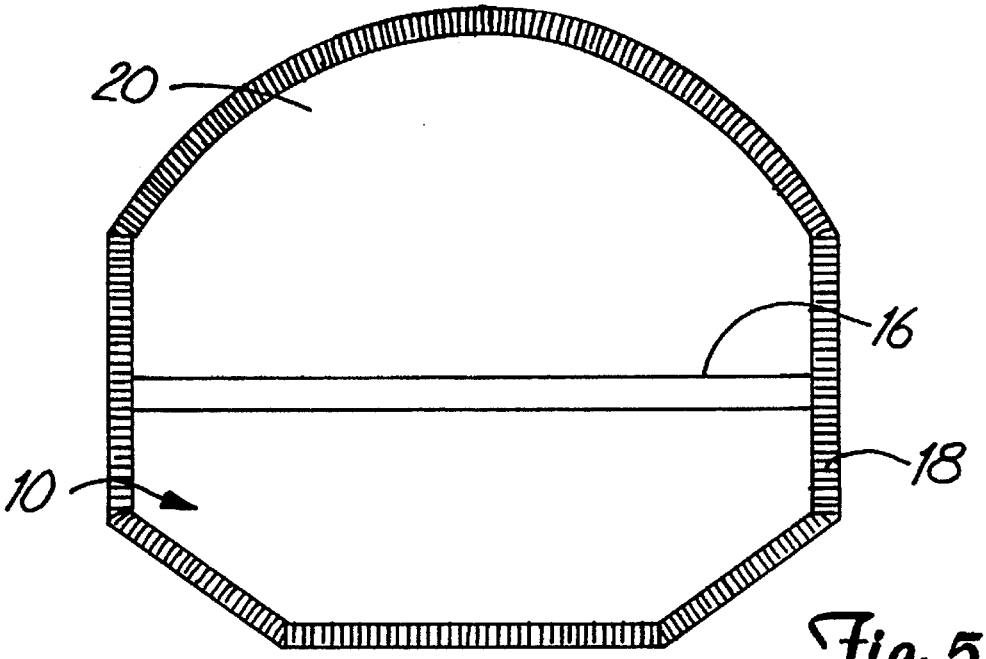
FIG. 5 is an elevated view of the cap strap cover comforter outside front side portion.

The cap strap comforter 10 and its construction is best illustrated in the exploded view shown in FIG. 3. A semi-circle pad substraight structure 24 with a cut-out gap in the middle section 26 provides a hinge means for folding. The front and back cover fabric 22 and 28 are joined together by both a double-seamed stitch 16 and a bias tape 18 when sewn around the outer edges of the front and back cover fabric 22 and 28 and the pad substraight structure 24. FIG. 5 best illustrates the above description.

The front and back cover fabric can be any of a variety of different fabric materials including leather, a cotton/polyester blend, or a twill material. The criteria for the fabric must take into consideration the application of a logo or decoration of the space provided on the front side of the cap strap cover comforter 20. A cotton/polyester blend can be embroidered, silk-screened, or have heat-sealed patch capabilities.

Figure 4:
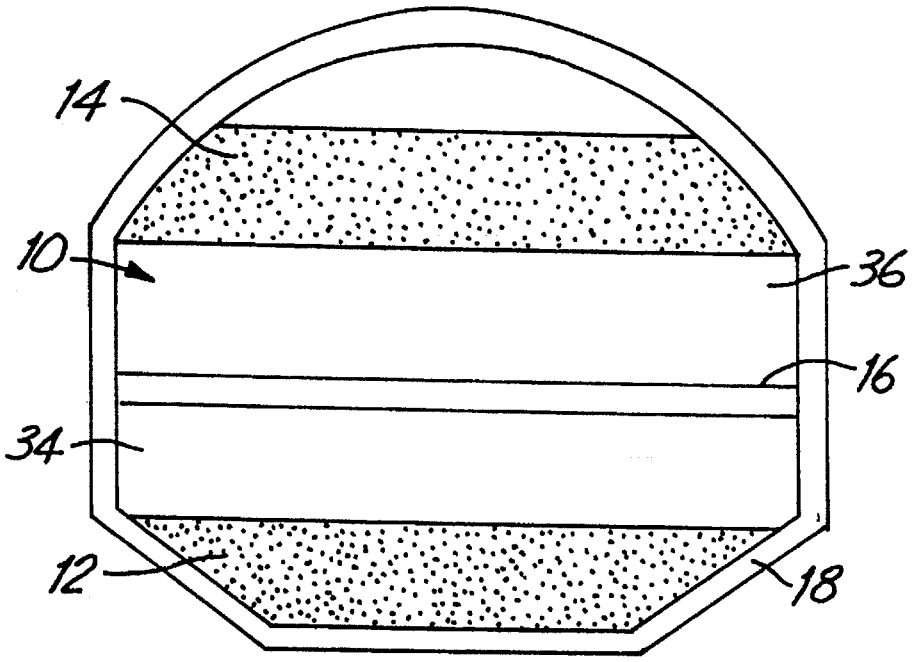
FIG. 4 is an elevated view of the cap strap cover comforter inside back side portion.

Once the above cap strap cover comforter 10, hook-and-loop fasteners 12 and 14 are sewn on the back cover fabric 22, the hook portion 12 is sewn onto the lower (first portion where the angled cuts are. FIG. 4 best illustrates the above description. The loop portion 14 is preferably sewn approximately ½" below the crest of the top (second) circular portion on the back fabric cover portion 28.

To apply the cap strap cover comforter 10 onto the cap sizing strap 32, place the inside lower portion 34 facing up, towards the inside of the baseball-style cap 30 and under the sizing strap. Place the hinged gap 26 double seam stitched 16 directly under the cap sizing strap 32. Fold the cap strap cover comforter 10 in an upward motion and secure the hook 12 and loop 14 firmly together.

Figure 6:
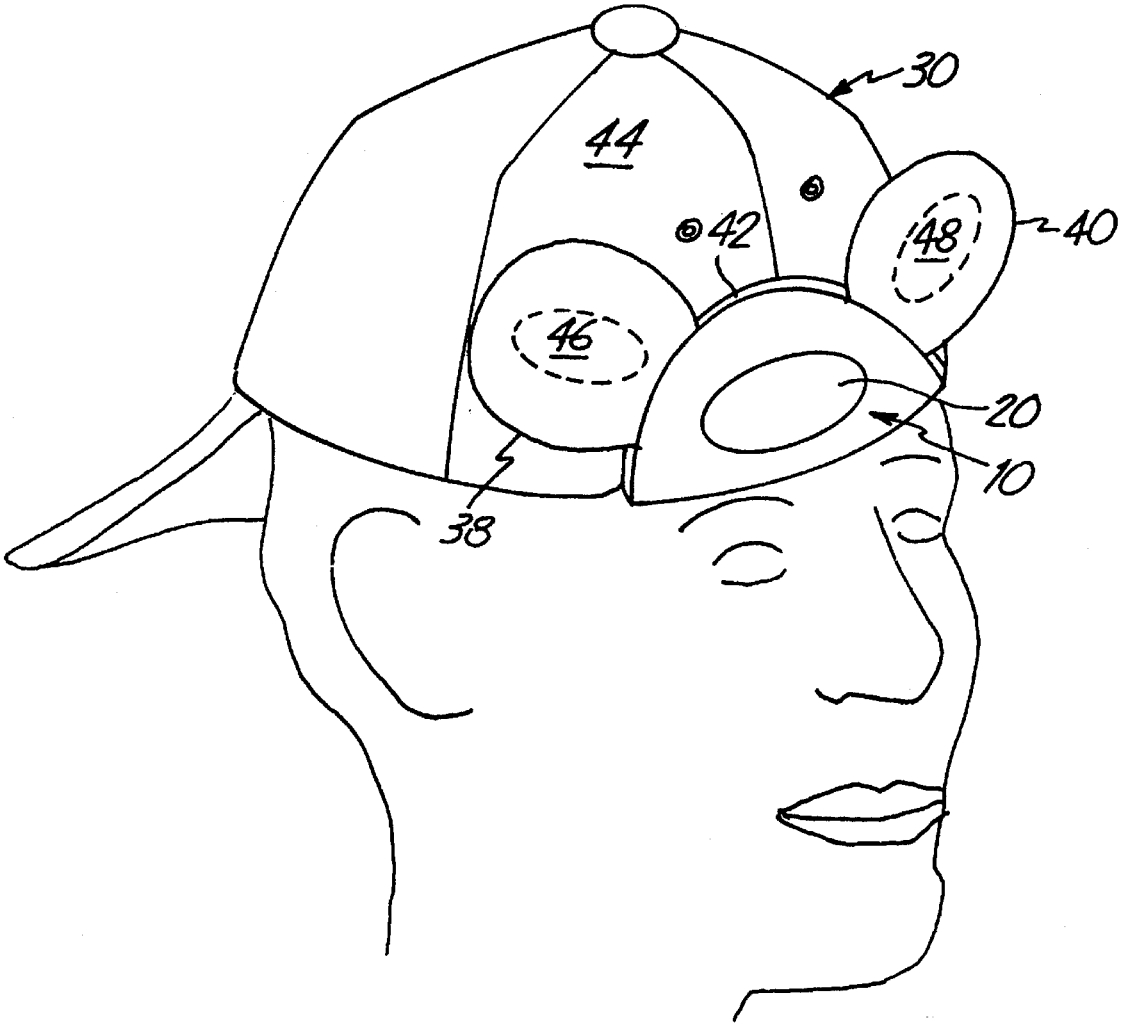
FIG. 6 is a perspective view of an improved cap strap comforting device with appendages for improved visibility according to the present invention.

FIG. 6 is a perspective view of one embodiment of comforter device 10 having appendages according to the present invention. The comforter 10, is formed as described with reference to FIGS. 1–5. However, comforter 10 also includes, in this preferred embodiment, a pair of appendages 38 and 40. Appendages 38 and 40 extend out and away from a generally hemispherical perimeter 42 of comforter device 10. While cap 30 has a dome or covering portion 44, appendages 38 and 40 extend out and away from covering portion 44 and do not generally conform to the contour of covering portion 44.

Appendages 38 and 40 are in one preferred embodiment provided with supplementary display surfaces 46 and 48, shown in phantom in FIG. 6. Display surfaces 46 and 48 preferably include displays which compliment or supplement the display on display surface 20. However, display surfaces 46 and 48 may, in the alternative, simply contain indicia which further draw attention to the display on display surface 20.

Appendages 38 and 40 can be formed in any number of ways. For instance, appendages 38 and 40 can be formed integrally with substraight 24, or front or back cover portions 22 or 28. Alternatively, appendages 38 and 40 can be stitched, seamed, or otherwise fused or fastened to any of substraight structure 24, or front or back fabric portions 22 or 28. As with cover fabric portions 22 and 28, appendages 38 and 40 can be formed of any of a variety of different material. Such materials include leather, a cotton/polyester blend or a twill material. Appendages 38 and 40, in the embodiment in which display surfaces 46 and 48 are included, must provide sufficient structural integrity and physical properties to accomplish the application of a logo on, or decoration of, display surfaces 46 and 48. It has been found that a cotton/polyester blend can be effectively embroidered, silk-screened or have a patch heat-sealed thereon to provide many desired forms of indicia.

Figure 7:
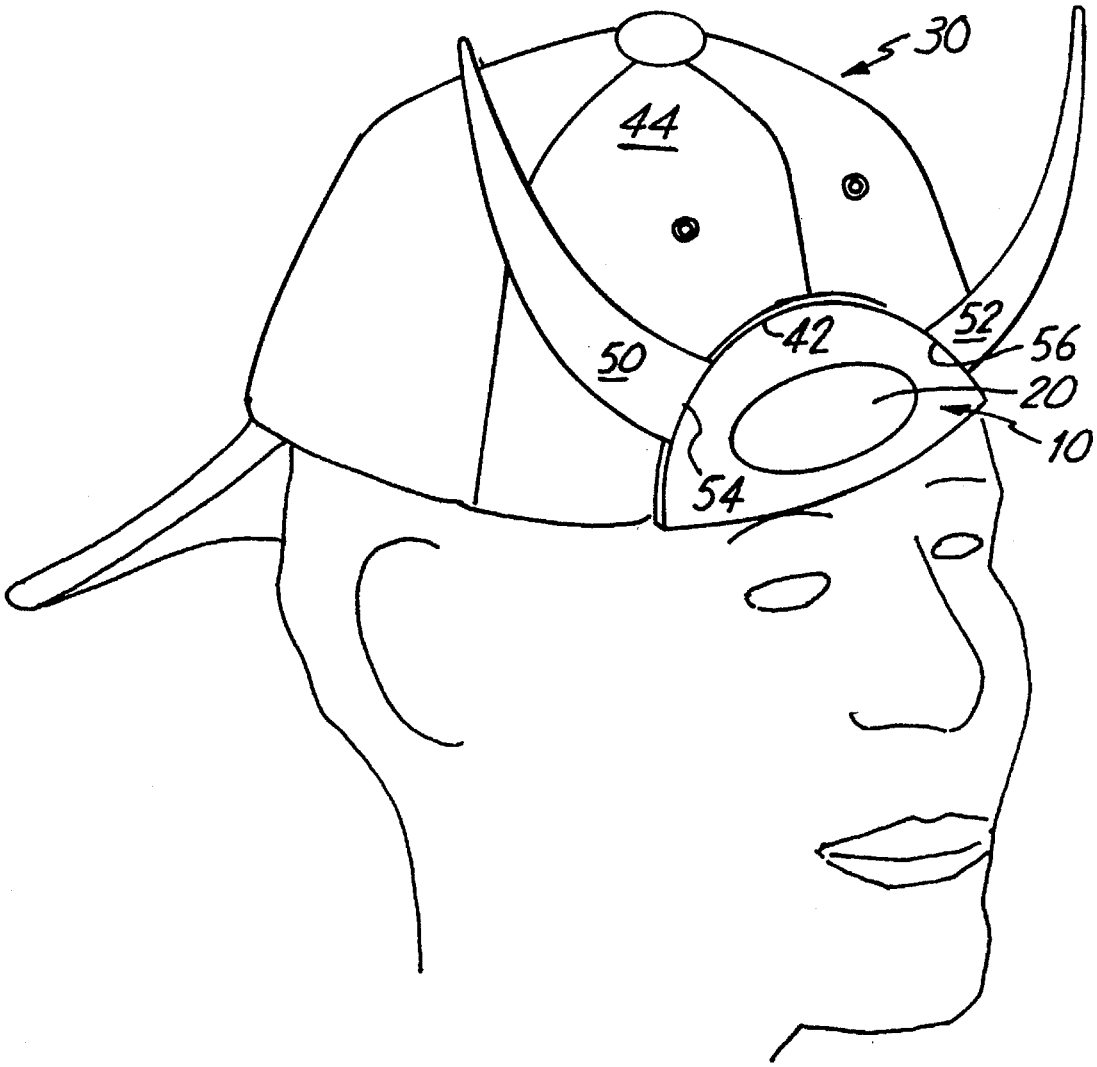
FIG. 7 is a perspective view of an improved cap strap comforting device with appendages for improved visibility according to the present invention.

FIG. 7 shows another embodiment of comforter 10 with appendages according to the present invention. In FIG. 7, appendages 50 and 52 are provided on comforter device 10. In the embodiment shown in FIG. 7, appendages 50 and 52 are spike-like structures which extend out and away from the generally hemispheric perimeter 42 of comforter device 10. As with appendages 38 and 40, appendages 50 and 52 also extend out and away from the cover portion 44 of cap 30 and do not generally conform to cover portion 44. This increases the visibility of comforter device 10 and draws additional attention to display surface 20 on comforter device 10.

It should be noted that, as illustrated in FIG. 7, appendages attached to generally hemispheric perimeter 42 need not be flat. Rather, they can be conical, as shown in FIG. 7, tubular, cylindrical, or any other suitable geometric shape. In addition, the appendages which extend from perimeter 42 can be any number of sizes. For example, appendages 38 and 40 shown in FIG. 6 do not extend above and beyond the sides of cover portion 44. However, appendages 50 and 52 shown in FIG. 7 extend both above cover portion 44 and beyond the sides of cover portion 44.

While the appendages which extend from perimeter 42 can assume generally any shape, it is preferred that the appendages taper to a substantially flat surface generally coplanar with comforter 10 at an interface (54 and 56 shown in FIG. 7) where the appendages attach to the generally hemispherical perimeter 42 of comforter device 10. This improves the comfort of comforter device 10 and also allows the appendages to extend in a natural looking manner.

Figure 8:
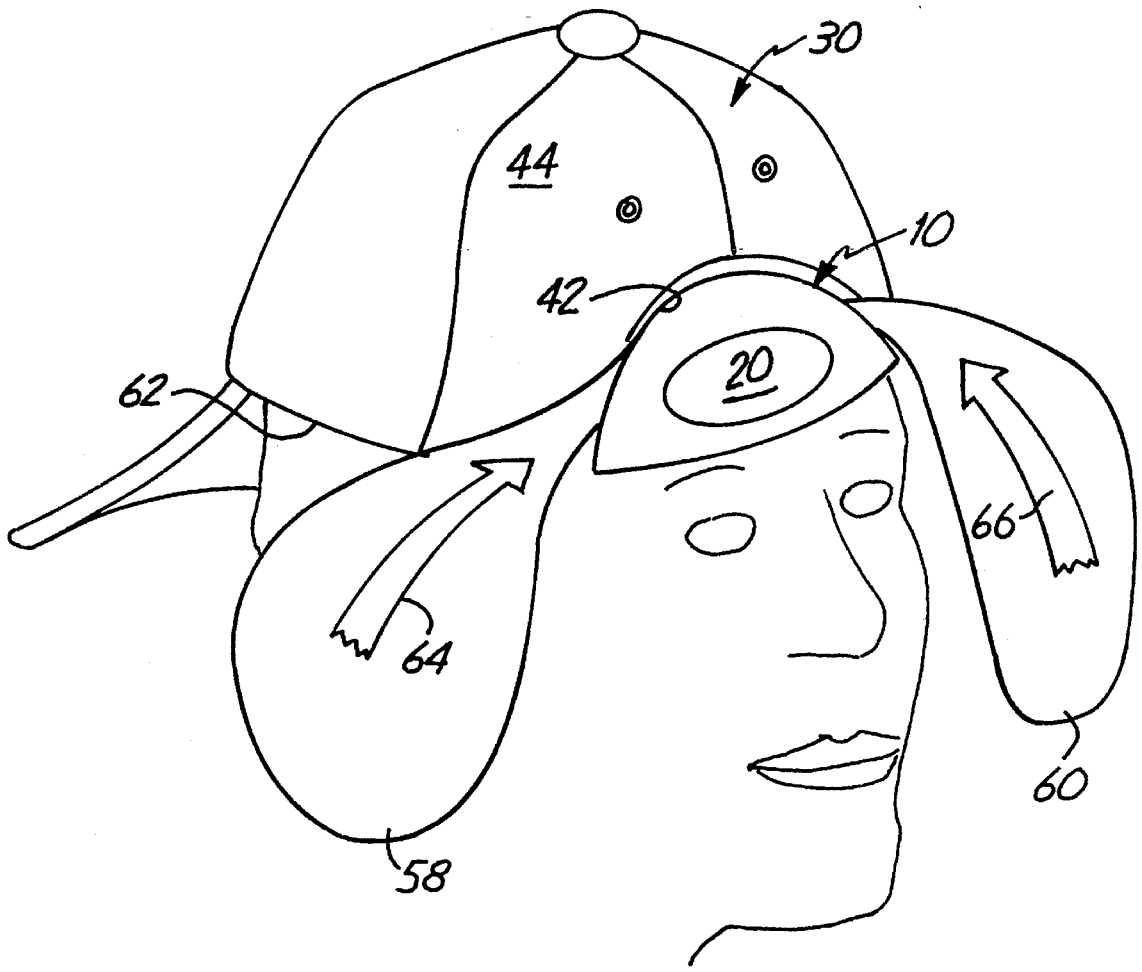
FIG. 8 is a perspective view of an improved cap strap comforting device with appendages for improved visibility according to the present invention, the appendages having indicia thereon for further drawing attention to the display area.

FIG. 8 shows yet another embodiment of comforter device 10 having appendages 58 and 60 extending from generally hemispheric perimeter 42. Similar items are similarly numbered to those shown in the previous figures. FIG. 8 shows that appendages 58 and 60 extend away and generally downward form generally hemispheric perimeter 42 of comforter device 10. As with the appendages 46, 48, 50 and 52, however, appendages 58 and 60 also do not generally conform to cover portion 44 of cap 30. Rather, they hang in a downward direction and extend beyond a lower rim 62 of cap 30. Thus, appendages 58 and 60 increase visibility of comfort device 10.

Appendages 58 and 60 in the preferred embodiment shown in FIG. 8 are also provided with indicia in the form of arrows 64 and 66. Arrows 64 and 66 point generally toward display surface 20. In the preferred embodiment, arrows 64 and 66 are formed of a reflective material which further draws attention to display surface 20 on comforter device 10. It should be noted that, where no indicia are desired on the appendages extending from generally hemispherical perimeter 42 of comforter device 10, the appendages may be made of any suitable material. However, where indicia are desired on the appendages, as stated with respect to appendages 38 and 4, the appendages must either be made of, or coated with, a suitable material which supports such indicia.

CONCLUSION, RAMIFICATIONS AND SCOPE OF INVENTION

The reader will see that my cap strap comforter device invention provides many functions in addition to covering an unattractive, uncomfortable sizing strap; it provides padded comfort, protection from weather, absorption of perspiration, and the ability to make a statement other than the logo already on the cap.

Also, my cap strap comforter device provides appendages extending generally from the perimeter thereof. The appendages not only increase the visibility of the cap strap comforter device, and hence the person wearing the cap, the appendages also draw further attention to the display or logo provided on the cap strap comforter device.

While the description contains many specifications, these should not be construed as limitations of the scope of the invention, but rather as an exemplification of the preferred embodiment thereof. Many other variations are possible. For example, the fastening device which secures and closes the cap strap cover comforter onto the cap sizing strap can be buttons, snaps, zippers, or hook-and-loop. The trim on the cap strap cover comforter edges can be pre-formed by surging, purled, morrowed or bias taped. The pad core substraight structure can be any closed- or open-pore spongelike material, foam rubber, or the like. Many fabrics can be used—cotton/polyester, leather, or cotton twill, to name a few. Accordingly, the scope of the invention should be determined not by the embodiments but by the append claims and their legal equivalents.

Although the present invention has been described with reference to preferred embodiments, workers skilled in the art will recognize that changes may be made in form and detail without departing from the spirit and scope of the invention.

What is claimed is:

1. In combination, a cap and a cap strap cover device for covering a sizing strap on the cap, the cap having a covering portion with a hemispheric opening adjacent the sizing strap, the cover device comprising:

a padded structure having a first portion and a second portion, the first and second portions being formed by hinge means for allowing the first and second portions to fold relative to one another into a folded position around the cap sizing strap, the padded structure including a perimeter and a display surface having a indicia displayed thereon, the display surface being located on the padded structure so that the indicia is visible when the padded structure is in the folded position;

fastening means for holding the first and second portions of the padded structure in the folded position around the cap sizing strap; and an appendage coupled to the padded structure and extending beyond the perimeter of the padded structure without conforming to the covering portion of the cap.

2. The combination of claim 1 and further comprising:

a second appendage coupled to the padded structure and extending beyond the perimeter of the padded structure without conforming to the covering portion of the cap.

3. The combination of claim 1 wherein the appendage is connected to the padded structure by a sewn seam.

4. The combination of claim 1 wherein the appendage is integral with the padded structure.

5. The combination of claim 1 wherein the appendage includes a second display surface having indicia displayed thereon.

6. The combination of claim 1 wherein the padded structure comprises a multi-layer structure, and wherein the appendage is connected to the padded structure between the layers thereof.

7. The combination of claim 6 wherein the appendage is integral with one of the layers of the padded structure.

8. The combination of claim 1 wherein the cover portion of the cap has a lower rim and wherein the appendage extends below the rim of the cap.

9. The combination of claim 1 wherein the appendage extends above an upper surface of the cover portion of the cap.

10. In combination:

a cap having a front portion with a hemispheric opening, a bill, and a rear portion with a sizing strap for sizing the cap, and a foldable strap cover for covering the sizing strap, the foldable strap cover, comprising:

a padded structure having a perimeter, first portion and a second portion, the first and second portions being joined by hinge means for allowing the first and second portions to fold relative to one another into a folded position around the cap sizing strap;

fastening means for holding the padded structure in a folded position around the cap sizing strap, the padded structure including a display surface displaying a symbol thereon, the display surface being positioned on the foldable strap cover so that the symbol is visible when the padded structure is in the folded position; and appendage means, coupled to the padded structure, for extending from the perimeter of the padded structure away from the padded structure.

11. The combination of claim 10 wherein the appendage means comprises:

a plurality of appendages coupled to the perimeter of the padded structure and extending generally away from the perimeter, the appendages not generally conforming to the cap.

12. The combination of claim 10 wherein the padded structure substantially covers the hemispheric opening in the cap.

13. The combination of claim 10 wherein the appendage means is formed integrally with the padded structure.

14. The combination of claim 13 wherein the padded structure comprises a plurality of layers, and wherein the appendage means comprises:

a plurality of appendages formed integrally with one of the plurality of layers of the padded structure.

15. The combination of claim 14 wherein the appendage means comprises:

a plurality of appendages connected to one of the plurality of layers of the padded structure by a sewn seam.

16. The combination of claim 14 wherein the appendage means comprises:

a plurality of appendages connected to the padded structure between two of the plurality of layers of the padded structure.

17. The combination of claim 10 wherein the appendage means comprises:

a plurality of appendages coupled to the padded structure, each appendage including a display surface having indicia displayed thereon.

18. The combination of claim 10 wherein a cap includes a rim and wherein the appendage means comprises:

a plurality of appendages extending from the perimeter of the padded structure and extending below the rim of the cap.

19. The combination of claim 10 wherein the cap includes a cover portion, and wherein the appendage means comprises:

a plurality of appendages extending above an upper surface of the cover portion of the cap.

20. In combination, a cap and a cap strap cover device for covering a sizing strap on the cap, the cap having a hemispheric opening adjacent the sizing strap, the cover comprising:

a multiple-ply padded structure having a first portion and a second portion, the first and second portions being joined by a hinge for allowing the first and second portions to fold relative to one another to form a semicircular pattern in a folded position around the cap sizing strap substantially covering the hemispheric opening in the cap;

fastening means for holding the padded structure in the folded position around the cap sizing strap, the fastening means including a hook and loop fastener having a first strip attached at a lower end of the second portion of the padded structure and a second strip attached to a central area of the first portion of the padded structure so the first and second strips contact one another when in the folded position; and the padded structure including a display surface having a symbol displayed thereon, the display surface being located on the padded structure so that the symbol is visible when the padded structure is in the folded position.

* * * * *